US006073575A

United States Patent [19]

Wotherspoon

[11] Patent Number: 6,073,575

[45] **Date of Patent: *Jun. 13, 2000**

[54] SAFETY SYSTEM

[75] Inventor: Geoff Wotherspoon, Lismore, Australia

[73] Assignee: Wotherspoon Foodservice Design Pty Ltd, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,266

[22] PCT Filed: Oct. 17, 1995

[86] PCT No.: PCT/AU95/00680

§ 371 Date: Apr. 30, 1997

§ 102(e) Date: Apr. 30, 1997

[87] PCT Pub. No.: WO96/13643

PCT Pub. Date: May 9, 1996

[30] Foreign Application Priority Data

Oct. 31, 1994 [AU] Australia ..... PM9314

[51] Int. Cl.[7] ..... G08B 6/00

[52] U.S. Cl. ..... 116/205; 116/DIG. 17

[58] Field of Search ..... 116/205, 215, 116/285, DIG. 17; 33/533, 645; 182/18, 106, 230

[56] References Cited

U.S. PATENT DOCUMENTS

| | | | |
|---|---|---|---|
| 3,408,025 | 10/1968 | Davis | 244/118 |
| 4,179,160 | 12/1979 | Sabo | 299/12 |
| 4,385,586 | 5/1983 | Schriever | 116/205 |

FOREIGN PATENT DOCUMENTS

| | | | |
|---|---|---|---|
| 0 454 318 A1 | 4/1991 | European Pat. Off. | A62B 3/00 |
| 80 24921 | 11/1980 | France | G08B 5/36 |
| 2 147 726 | 5/1985 | United Kingdom | G09F 19/22 |
| 2 224 154 | 4/1990 | United Kingdom | G09F 19/22 |
| WO 89/04410 | 5/1989 | WIPO | E04F 11/18 |
| WO 91/16513 | 10/1991 | WIPO | E04F 11/18 |
| WO 93/12837 | 7/1993 | WIPO | A62B 3/00 |
| WO 93/13504 | 7/1993 | WIPO | G08B 7/06 |

*Primary Examiner*—Hezron Williams
*Assistant Examiner*—Willie Morris Worth
*Attorney, Agent, or Firm*—Fish & Richardson P.C.

[57] ABSTRACT

A system for aiding emergency evacuation of people from a building, comprising a plurality of rails (51) with each rail (51) being associated with a direction indicator (54) comprising a tactile portion (66) which indicates the direction a person must move in to find an exit.

30 Claims, 10 Drawing Sheets

SAFETY SYSTEM

FIELD OF THE INVENTION

The present invention is particularly concerned with systems for safely evacuating people from a building where loss of sight or hearing occurs, for example, during a fire, explosion, earthquake, etc.

BACKGROUND OF THE INVENTION

For safety reasons all buildings require emergency exits and the location of these exits is indicated by suitable signage. In addition to this audible alarms are provided to indicate when a fire occurs.

The problem with the above arrangement is that in large buildings such as warehouses, when a fire occurs the presence of smoke can reduce visibility to such a level that exit signs are impossible to see. In such a situation a fire alarm does not indicate which direction a person should proceed in to escape the fire.

SUMMARY OF THE INVENTION

According to the present invention there is provided a system for aiding emergency evacuation of people from a building, comprising a plurality of rails with each rail being associated with at least one direction indicator comprising a tactile portion which indicates the direction a person must move in to find an exit, wherein at least one rail is provided with a direction indicator for directing a person from one rail across a discontinuity to another rail or exit, whereby a person using only the sense of touch can locate an exit starting from any rail and across any discontinuity between rails.

Preferably each rail comprises a plurality of direction indicators.

Each direction indicator may be arranged to be touched by a person sliding a hand along a rail.

The direction indicator tactile portion preferably comprises an indicator member which is movable from a first position to a second position to indicate that a person moving the indicator member should proceed in the direction in which the member is movable.

Preferably the rails are wall mounted.

It is preferred that in the first position, the indicator member is substantially perpendicular to the rail.

The indicator member may be pivotable from the first to the second position.

The direction indicator preferably comprises a biasing means for urging the indicator member to the first position.

The biasing means may comprise a cam means which is arranged to return the indicator member to the first position.

The direction indicator preferably comprises an elongate member which is pivotable about its central longitudinal axis.

Preferably the indicator member is supported on the elongate member.

The elongate member may comprise a lower cam portion with a cam surface.

Preferably the cam surface is located on a lower surface of the elongate member.

The lower cam portion may be arranged to be seated on a support member.

Preferably the support member has an upper surface with a cam surface thereon.

The support member may comprise a shaft in its upper surface which is arranged to receive a lower axial portion of the elongate member.

Preferably the cam surface of the lower portion is arranged to be seated on the upper cam surface of the support member.

The lower cam surface may comprise a convex lower most portion.

Preferably the upper cam surface comprises a concave portion.

The upper cam surface and cam member may be arranged to rest on the lower cam surface with the indicator member in the first position.

Preferably the lower cam surface and the cam member is rotatable with respect to the upper cam surface.

The cam member may be arranged under the force of gravity to be urged back to a position where the indicator member is in the first position.

Preferably the cam member is substantially cylindrical in shape and is arranged to be received over a lower portion of the elongate member.

The indicator member may be arranged to be received on an upper portion of the elongate member.

The elongate member may comprise a planar member.

Preferably the rail comprises a cylindrical portion which is arranged to be held by a person so as to guide the person in a particular direction.

The indicator member preferably comprises a tactile portion which is arranged to be touched by a person holding an adjacent portion of the cylindrical portion of the rail.

The tactile portion preferably comprises a lever which points towards the cylindrical portion.

It is preferred that the lever has a central longitudinal axis which intersects the central longitudinal axis of the cylindrical portion.

The rail may comprise balustrading.

Preferably the rail comprises a mounting means.

The mounting means may be arranged to be connected to the support member.

The indicator member preferably is connected to the mounting means.

According to one embodiment the indicator member is arranged to be attached to a support structure through a pivot.

Preferably the mounting means forms the support structure.

A wall may form the support structure.

Preferably the pivot is normally urged to the first position.

The support structure preferably comprises a stop which is arranged to limit movement of the indicator member.

The stop may prevent the indicator member from pivoting from the first position in the opposite direction to the second position.

The stop may be connected to the mounting means.

The mounting means may comprise a bracket assembly.

Preferably the bracket assembly in integrally formed with the rail.

It is preferred that the rail comprises end portions with indicator means.

Preferably the indicator means comprises shaped portions.

The shaped portions may indicate a direction for a person to move in.

It is preferred that movement of the indicator member in one direction means a person should proceed in one direction, that is the direction of movement of the indicator member.

Preferably movement of the indicator member in two directions means a person can proceed in either direction while holding onto the rail.

If the indicator means is fixed and unable to move, it is preferred that this means a person must move at 90° to the length of rail.

Preferably the shaped portions comprise either one of the following: an angled surface to indicate a person should move at 90° with respect to the rail; a straight surface perpendicular to the length of the rail to indicate that a person should proceed in the same direction as the rail; and a curved portion to indicate that a person should follow the curve of the rail.

Preferably an indicator means is provided at each end of each rail.

Preferably an indicator member is provided at each end portion of the rail.

Preferably the indicator member is located between the rail and a supporting wall.

According to another embodiment of the present invention the direction indicator is provided on each rail at predetermined locations.

Preferably the tactile portion comprises a tactile arrow in the form of a raised portion on the surface of the rail.

According to another embodiment the tactile portion comprises a ratchet member with a stop surface which is arranged to be touched by a person's hand when the hand is slid along the rail in one direction and also comprising a shoping portion which allows a person to slide their hand over the top of it in the opposite direction.

Preferably the ratchet member may be depressed below the surface of the rail and is normally urged to protrude above the surface of the rail.

According to another version of the present invention the rails are in the form of strips which are arranged to be connected to a support structure.

Preferably the support structure is a wall.

According to one embodiment the rails are connected at approximately one meter above ground level.

According to another embodiment of the present invention the direction indicator is spring loaded to return to a predetermined position.

Preferably the direction indicator comprises a raised portion on the surface of the rail.

Preferably the raised portion indicates to the person touching it which direction to proceed in.

A preferred embodiment of the present invention will now be described by way of example only with reference to the accompanying drawings in which:

DESCRIPTION OF THE PREFERRED EMBODIMENTS

Figure 1:
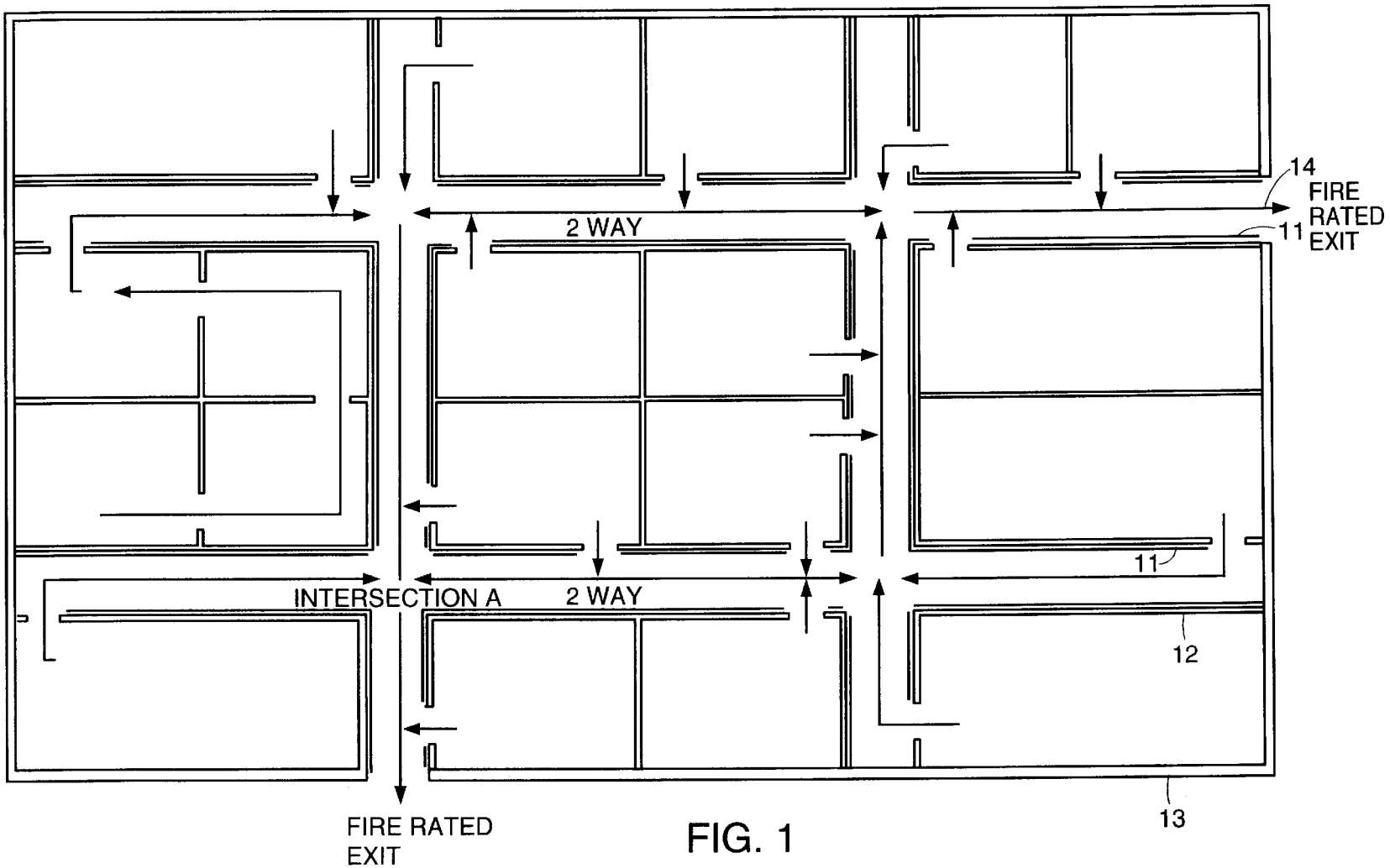
FIG. 1 shows a top view of a railing system according to one embodiment of the invention.

A railing system which incorporates direction indicators so that a person during fire evacuation can find their way to a fire exit without the aid of visual or audible indicators, is shown in FIG. 1. The actual direction indicators are not shown in FIG. 1, these are shown in the succeeding Figures.

The railing system of FIG. 1 requires rails to be connected to passageway walls 12 throughout the building 13. Because a rail is provided on each side of the passageway in every passageway, a person not knowing the location of a fire escape and being visually impaired is able to hold onto a rail and using directional indicators of the rail find the way to the closest fire exit.

The arrows 14 indicate the direction that a person must proceed in to reach a fire exit. Accordingly each rail is required to have a direction indicator which directs a person in the direction of the arrows.

Figure 10:
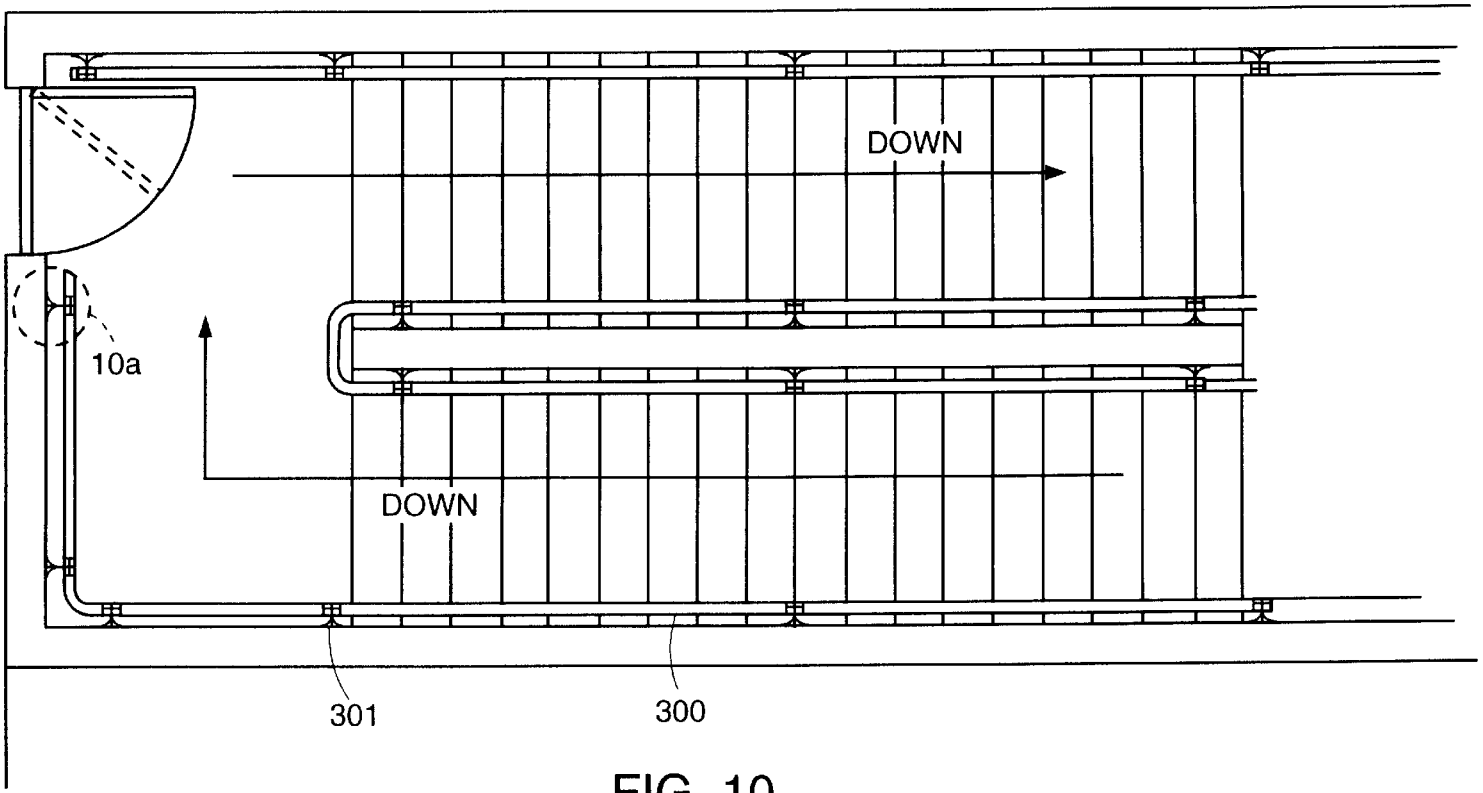
FIG. 10 shows a railing system used in a stairwell.
Figure 10A:
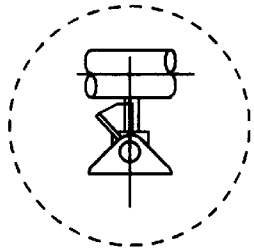

FIG. 10 shows how a railing system 300 can be installed in a stairwell utilising direction indicators 301 which will be discussed in more detail hereinafter.

In accordance with the first embodiment of the present invention it has been determined that a person can be directed to a fire exit using rail terminal indicators which indicate to a person to proceed straight ahead across a door opening from one rail to another or across a passageway from one rail to another, or at 90° from one rail to a rail on an opposite wall of the same passage. A separate direction indicator is also provided on the rail to indicate the direction a person must move in to get towards the fire exit.

Figure 2:
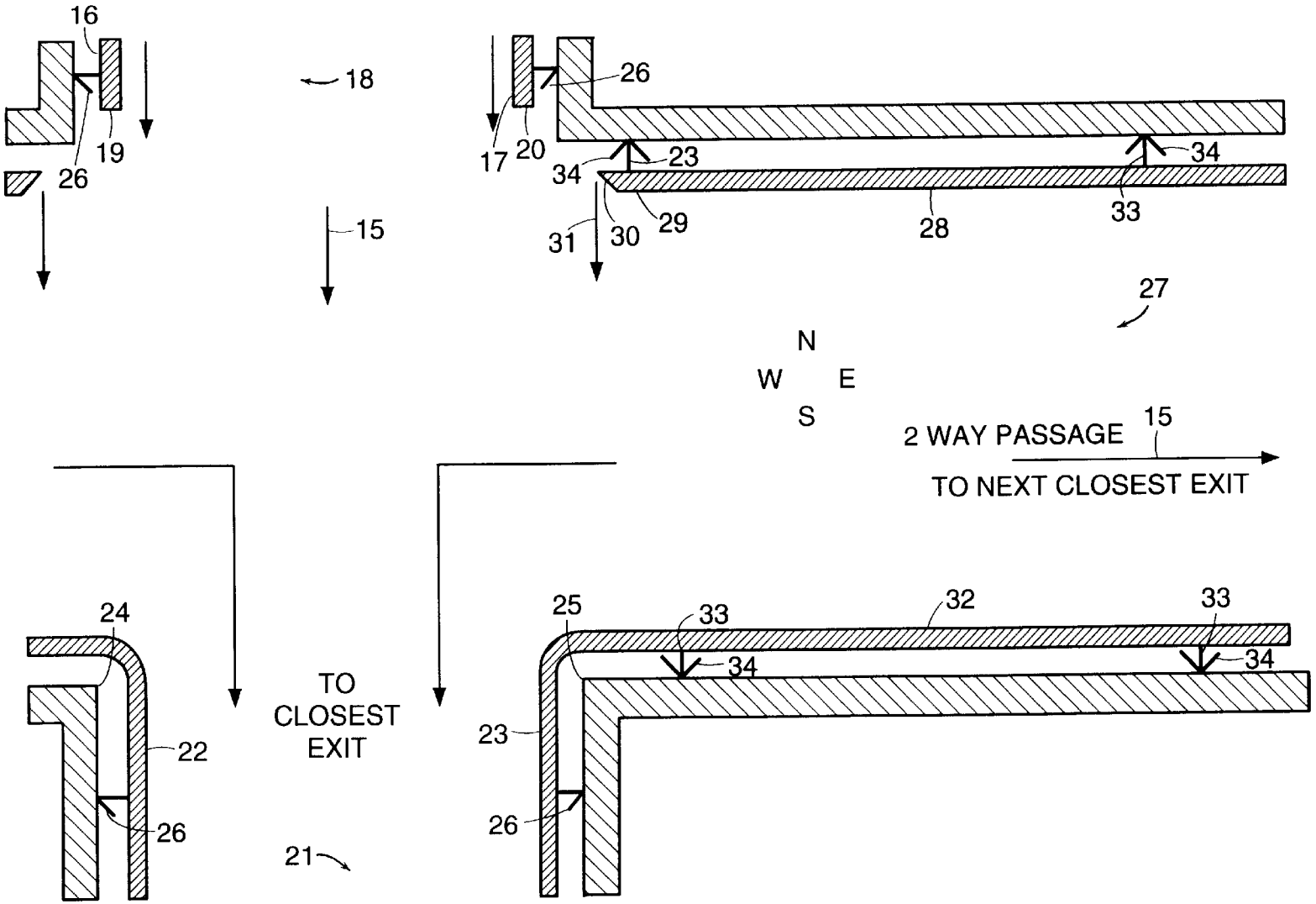
FIG. 2 shows a railing system for a passageway of a building according to a first embodiment of the present invention.

FIG. 2 shows a four way passageway with arrows 15 pointing in the direction of the closest fire exits, in this case in a southerly direction or in an easterly direction.

For the four way passage shown the two rails 16, 17 of the northern passage 18 are provided with straight end faces 19 and 20 respectively. These straight end faces 19, 20 indicate to a person holding the rail to proceed straight ahead across the junction of the passage.

On the other, side of the junction of the passages the south passage 21 is provided with hand rails 22 and 23 respectively and these extend around corners 24 and 25 into the western and eastern passage respectively. Both the north and south passages are provided with direction indicators 26 between the rail and adjacent wall and the angled portion of each direction indicator indicates the direction in which the direction indicator is movable and thus the direction in which a person should move towards the fire exit.

The eastern passageway 27 is shown with a rail 28 on its north wall. At the western end 29 of rail 28 the rail terminates in an angled section 30. This angled termination 30 indicates to a person touching it that they must proceed at right angles to the rail to the other side of the passage as indicated by arrow 31.

Because there is a fire exit at the end of the eastern as well as the southern passageways, rail 28 and the opposing rail 32 on the south wall each have direction indicators 33 with two angled arms 34. This type of direction indicator indicates to a person touching it that they can move in either direction along the passageway to get to the nearest fire exit.

Figure 3:
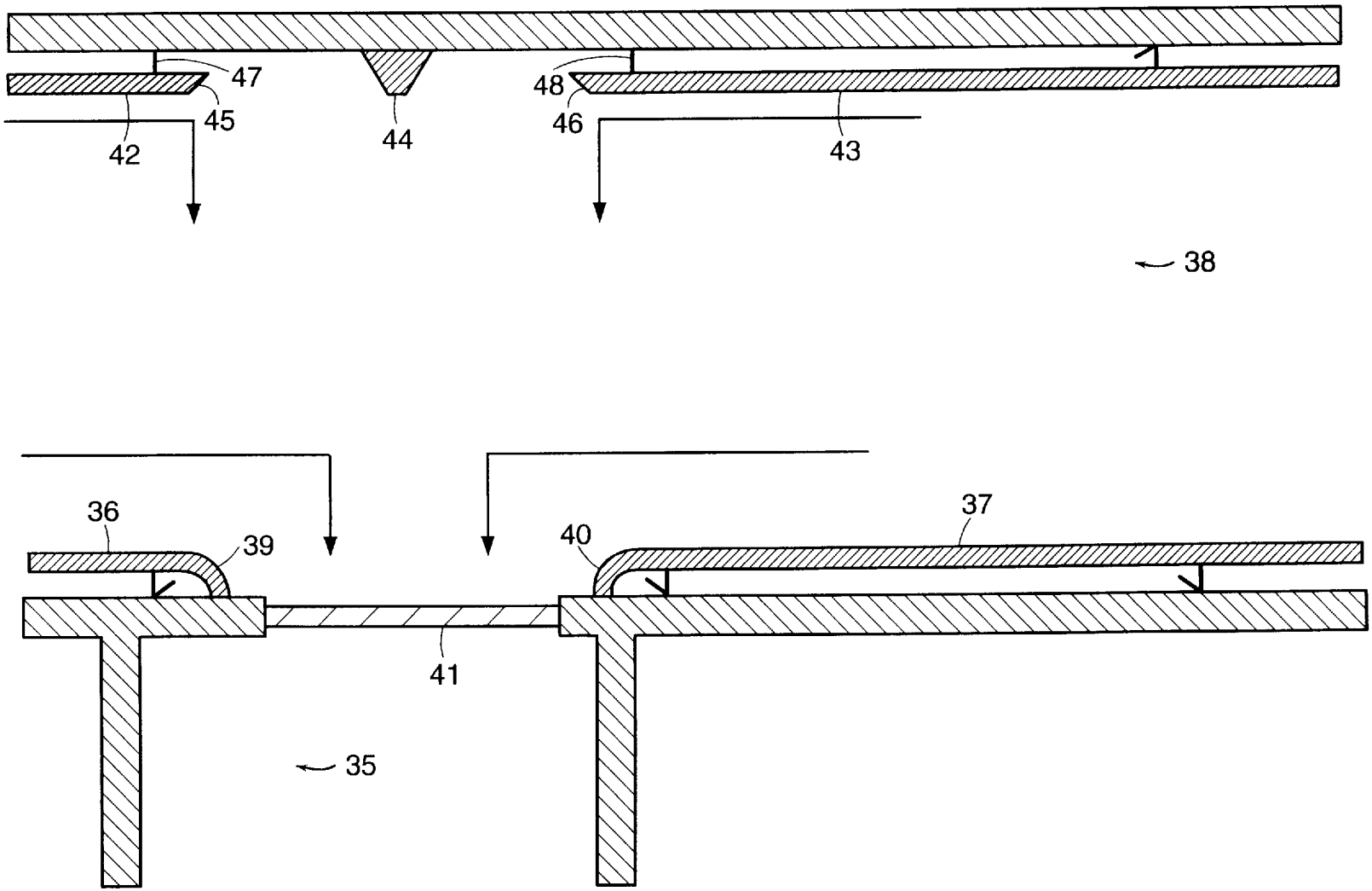
FIG. 3 shows a railing system for a passageway of a building according to a second embodiment of the present invention.

FIG. 3 shows a railing system for a passageway with a doorway to a stairwell 35. The rails 36 and 37 on the south side of the passageway 38 have curved end portions 39 and 40 respectively which abut with the adjacent wall on either side of the door 41. These curved ends 39 and 40 indicate to a person touching them that they have come to a doorway and must therefore open the door 41 to proceed into the stairwell 35.

On the north wall of the passage 38 rails 42 and 43 are provided on each side of a fixed wall indicator 44. The fixed wall indicator 44 is a wedge shape structure which has the apex of the wedge pointing towards the door 41. Each of the rails 42 and 43 is provided with an angled termination 45, 46 which indicates a person should move at right angles to the other side of the wall and therefore to the door 41. Each of the rails 42 and 43 is also provided with fixed direction indicators 47, 48 respectively near each termination 45, 46. Because the direction indicators cannot move this indicates that the person is approaching the end of a rail and will then have to move at 90° to the rail, that is towards the opposite wall.

According to the preferred embodiment a direction indicator is located 100 mm from each end of a rail. In addition to this, where a rail goes around a corner a direction indicator is located on each side of the corner 300 mm from the corner. Desirably each direction indicator is no more than 2 meters apart subject to strength and nature of the supporting structure, and length of clear run in one direction as a factor to extend spacing, but not to effect integrity of the system.

Figure 4A:
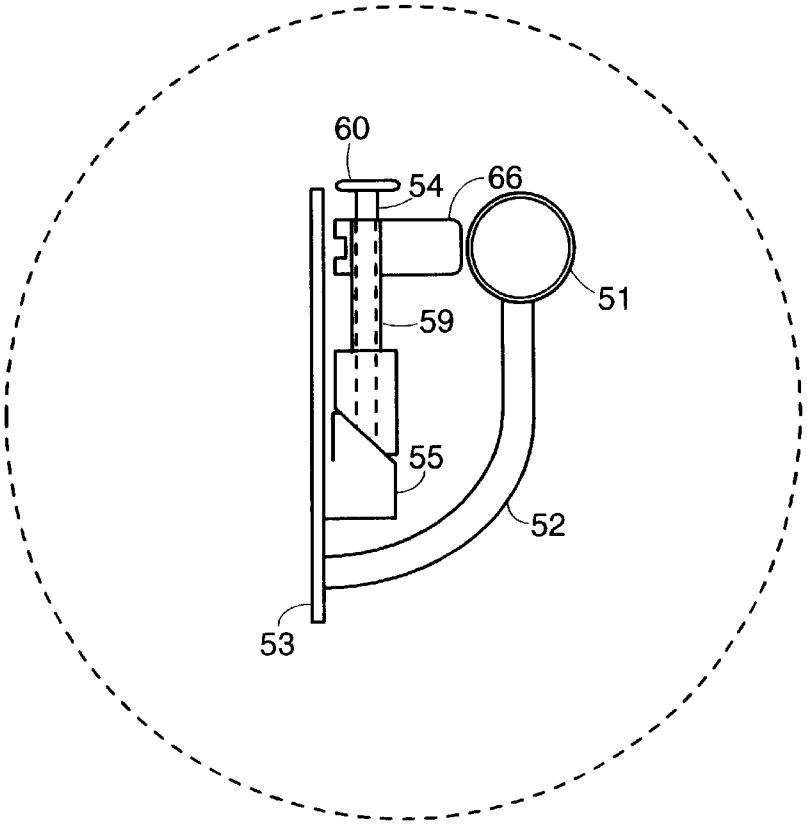
FIG. 4*a* shows a rail assembly incorporating a direction indicator according to a first embodiment of the present invention.
Figure 4B:
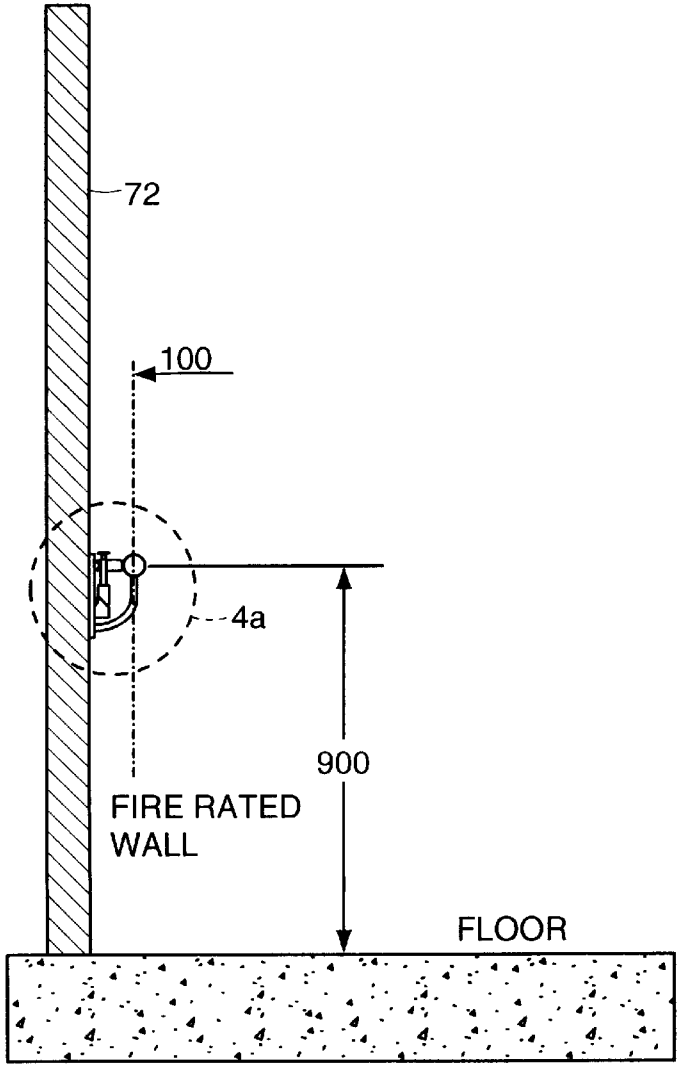
FIG. 4*b* shows the rail assembly attached to a wall.

FIGS. 4*a* and 4*b* show a rail assembly according to the present intention.

Figure 5C:
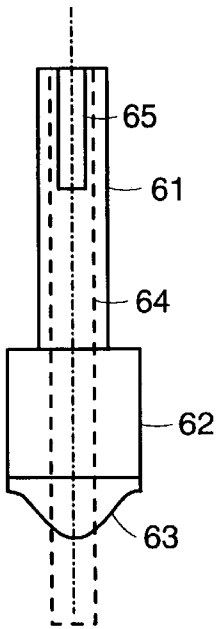
FIG. 5*c* shows a front view of a support shaft of a direction indicator shown in FIG. 5*b;*
Figure 5B:
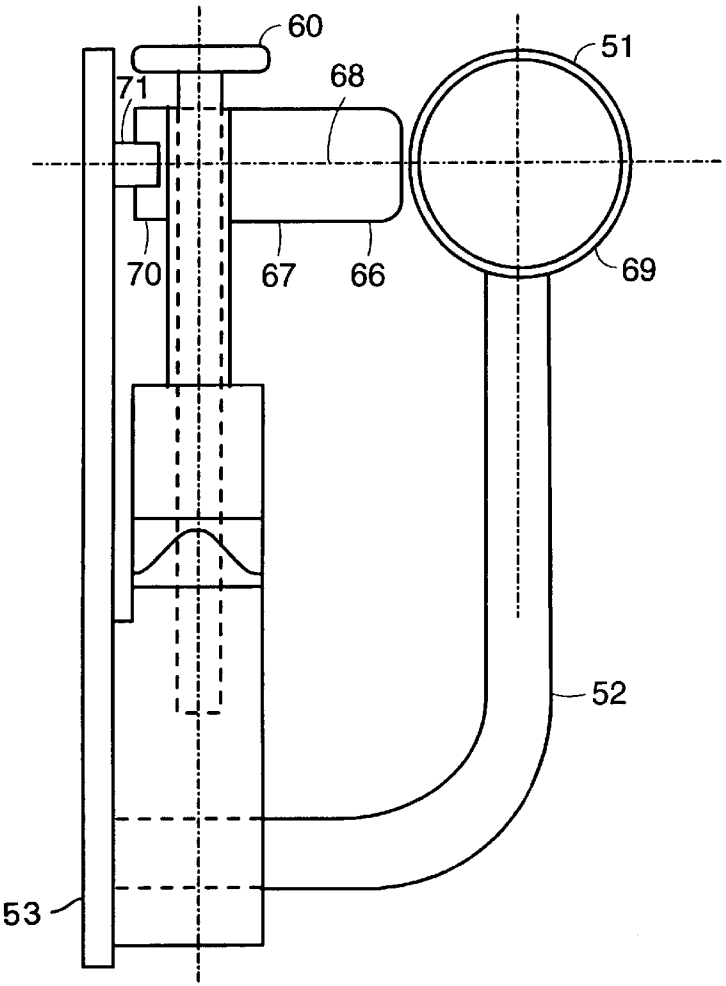
FIG. 5*b* shows a side view of the rail assembly shown in FIG. 5.
Figure 5A:
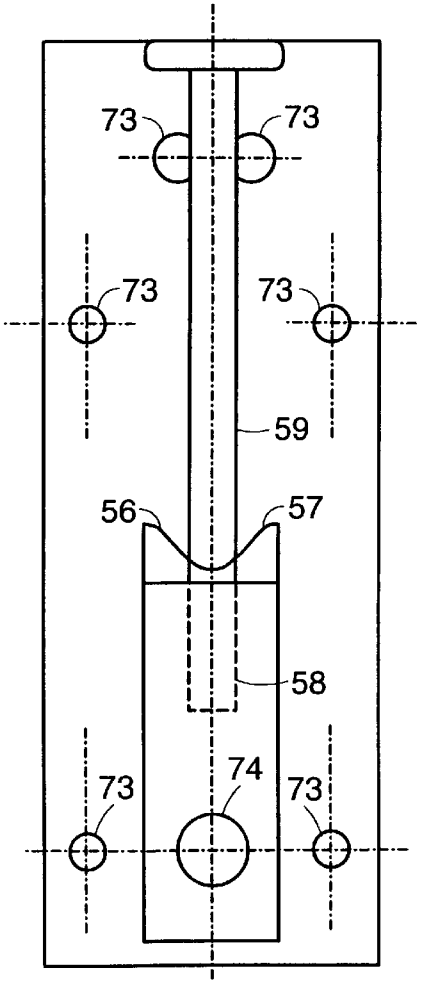
FIG. 5*a* shows a front view of the rail assembly of FIG. 4*a* and FIG. 4*b;*

FIGS. 5*a* to 5*c* show a more detailed representation of the rail assembly.

As shown the rail assembly consists of a hand rail 51 and a supporting balustrade 52. The balustrade 52 extends in an arc upwardly to the hand rail 51 from a lower part of a bracket plate 53.

A direction indicator 54 is attached to the bracket plate 53 just above and or located by the balustrade 52 and consists of a lower angled support 55 with its top wall 56 having a concave shaped cam surface 57. Through the centre of the angled support 55 a passage 58 is provided through the top surface 56. Received in this passage 58 is the lower end of a shaft 59, the top of the shaft 59 is provided with a head 60 as a means of restriction.

A sleeve member 61 is shown in FIG. 5C with a lower collar 62 having a cam surface 63 at its lower end. The cam surface 63 is convex in shape and has a matching shape to that of the cam surface 57.

The sleeve 61 and its collar 62 and cam surface 63 have a central passage 64 extending therethrough which allows the sleeve 61 to be received on the shaft 59 as shown in FIG. 4*a*. An upper part of the sleeve 61 is provided with a slot 65 which receives a planar lever 66 which has its major part 67 pointing towards the handrail 51 and its longitudinal axis 68 aligned with the centre 69 of the handrail 51. On the other side of the sleeve 61 a small portion 70 of the lever 66 is aligned with a stop 71 which has the same longitudinal axis 68. The head 60 at the top of the shaft 59 prevents the lever 66 from being removed.

As shown the end of the large portion 67 of the lever 66 is very close to the adjacent handrail 51. This is to ensure that a persons hand touches it when the hand is slid along the rail 51.

The stop 71 is mounted to the planar bracket 53.

As shown in FIG. 4*a* the handrail 51 supporting balustrade 52, direction indicator 54 and stop 71 are all attached to the planar bracket 53, this can then be mounted to a wall 72 as shown in FIG. 4*b* by any suitable anchoring means inserted through the lugholes 73 shown in FIG. 5*a*.

As shown in FIG. 4*b* the handrail is preferably 100 mm from the wall once the planar bracket is attached to the wall and the handrail is 900 mm from the floor.

It should also be noted that the lugs 74 in the centre of then angled support 55 is arranged to receive the lower end of the balustrade 52.

In use during an emergency evacuation of a building, with the railing system installed, a person does not need to rely on visual or audible indicators to find the nearest fire exit. Instead a person can slide their hand alone the handrail 51 and eventually the hand will touch a lever 66. If the fire exit is only reachable at one end of the passageway in which the railing system is installed, the lever will only be pivotable in that direction. Thus in FIG. 4*a* the lever 66 will pivot with the sleeve 61 with respect to the cam surface 57 of the angled support 55. Once the hand has passed the shape of the cam surfaces 57 and 63 will force the sleeve 61 under the action of gravity to return to its original position at which the lever 68 is again pointing at the handrail 51.

The stop 71 prevents the lever from returning beyond its original starting position.

If fire exits are located at either end of the passageway in which the rail is installed the stop 71 is removed so that a hand moving along the rail 51 in either direction will be able to move the lever 68. Because the lever 68 can move in either direction this would indicate to a person that a fire exit is locatable at either end of the passageway.

By providing stop 71 on either side of the lever it is possible to prevent the lever from moving in any direction. If a person sliding their hand along the handrail 51 then strikes the lever 68 and feels that it cannot move this indicates to them that they must move at right angles and therefore across the passageway to the opposite wall. Once there the handrail of that wall will indicate which way to go.

The above embodiment is a preferred embodiment of the present invention and it is envisaged that other rails and direction indicators could be utilised in accordance with the invention.

According to another embodiment of the present invention the rail assembly and direction indicator shown in FIGS. 5*a* to 5*c* can be replaced by another rail assembly and direction indicator as shown in FIGS. 6*a*, 6*b*, 7*a* and 7*b*.

Figure 6A:
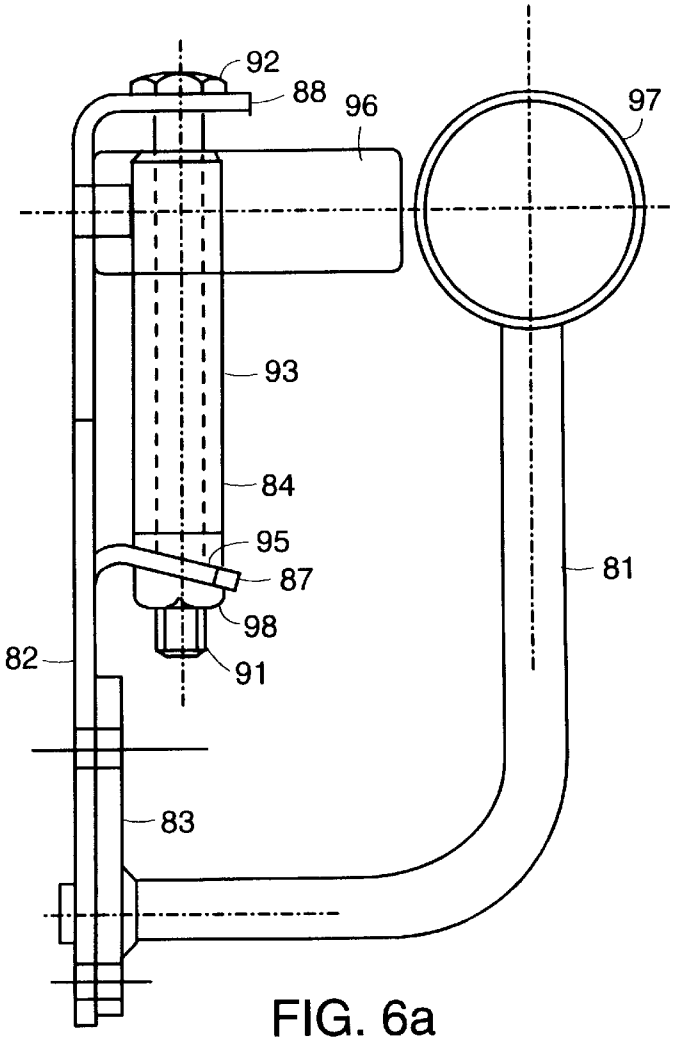
FIG. 6*a* shows a side view of a rail assembly according to a second embodiment of the present invention.
Figure 6B:
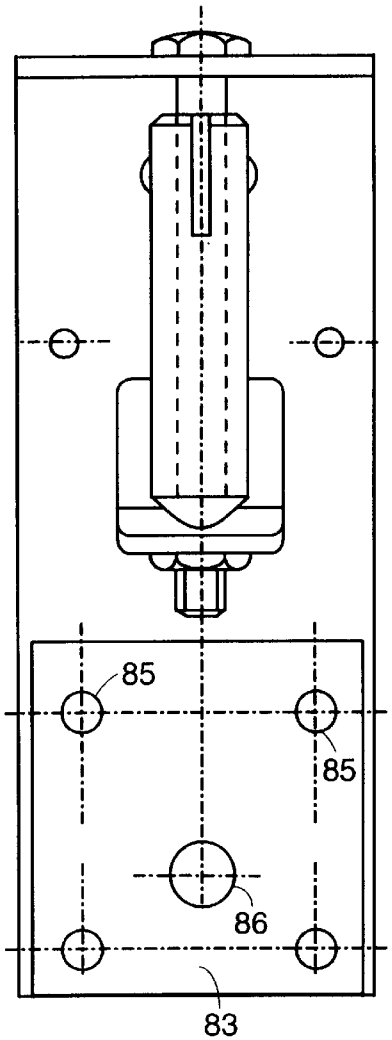
FIG. 6*b* shows a front view of the rail assembly shown in FIG. 6*a;*

The rail assembly shown in FIG. 6*a* is effectively the same as that shown in FIG. 5*b*, although the mounting plate for connecting the handrail balustrading 81 (to plate 82) is different in shape because it does not have to support the direction indicator 84. As shown in FIG. 6*b* the bracket plate is effectively a squarish plate with a central hole slightly lower than the absolute centre of the square. The hole receives the balustrading 81 and bolt holes 85 allow the bracket plate 83 to be attached to the supporting bracket 82.

The direction indicator 84 is different to that shown in FIG. 5*b* primarily because of the way it is supported at its lower end by a support bracket 87 which extends at an angle slightly below the horizontal from the support bracket 82. At its upper end the direction indicator 84 is supported by a top section 88 of the support bracket. This top section is formed by bending the top end of the support bracket from a vertical to a horizontal orientation.

Figure 7B:
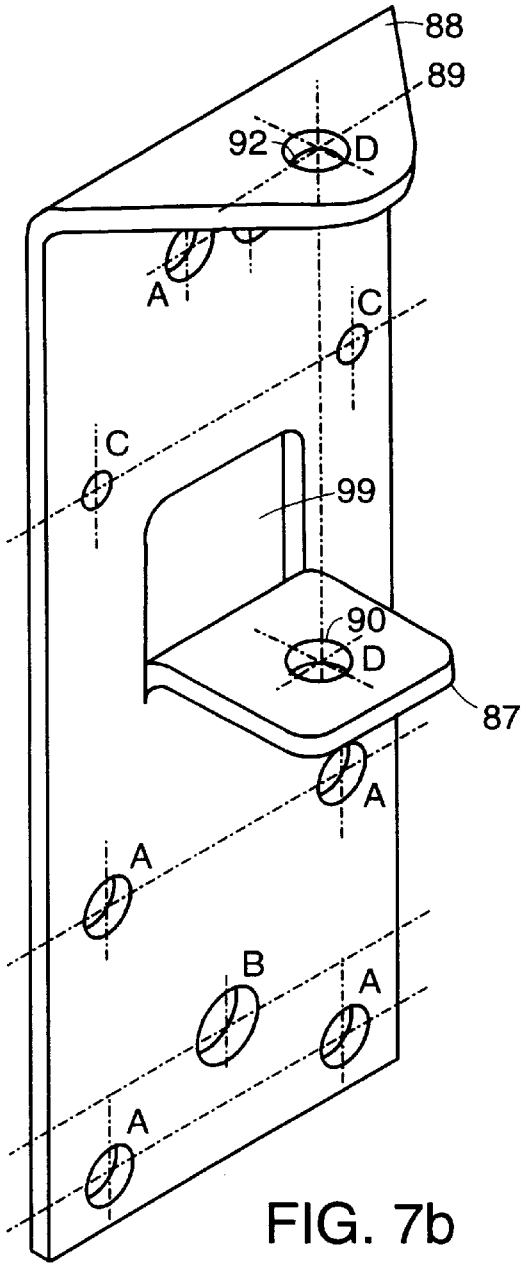
FIG. 7*b* shows an angled view of the support bracket shown in FIG. 7*a;*
Figure 7A:
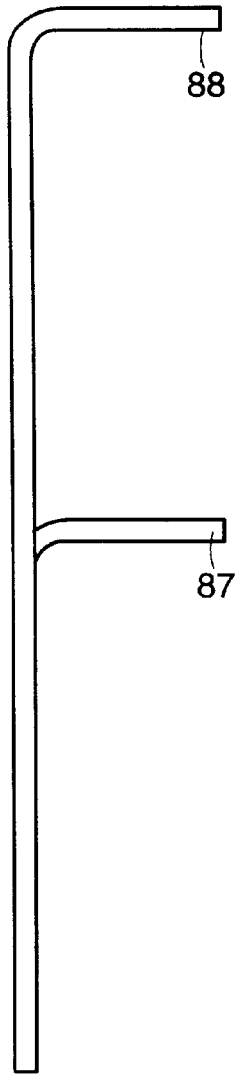
FIG. 7*a* shows a side view of a support bracket for a direction indicator according to a second embodiment of the present invention.

As shown in FIGS. 7*a* and 7*b* initially both bracket sections 87 and 88 are aligned in parallel one above the other with holes 89 and 90 respectively aligned along a vertical axis. A central bolt 91 of the direction indicator is received through both of these holes with the head of the bolt 92 resting on the top surface of section 88.

By bending the lower bracket section 87 downwardly the outer sleeve section 93 of the direction indicator can have its lower end shaped so that the lower surface has a matching shape to that of the angled lower bracket section 87.

With the lower surface 95 lying flush against the top surface of bracket section 87, lever 96 can be oriented so that it is perpendicular to the adjacent hand rail 97. Because the sleeve section 93 is freely moveable vertically along bolt 91 if lever 96 is moved away from its resting position perpendicular to handrail 97, face 95 is no longer flush with the upper face of bracket section 87. Accordingly under the action of gravity the sleeve 93 tries to assume its resting position with its surface 95 flush against the upper surface of bracket section 87, thus restoring lever 96 to its resting position.

Underneath bracket section 87 a specially shaped support nut 93 ensures the end of bolt 92 cannot be withdrawn accidentally.

As shown in FIG. 7*b* bracket section 87 is effectively formed by bending a cutout section from support bracket 82 so as to leave a window 99.

Figure 8A:
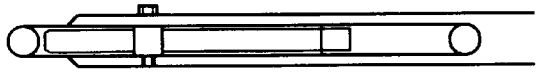
FIG. 8 shows a handrail assembly incorporating a direction indicator according to a third embodiment of the present invention.
Figure 8:
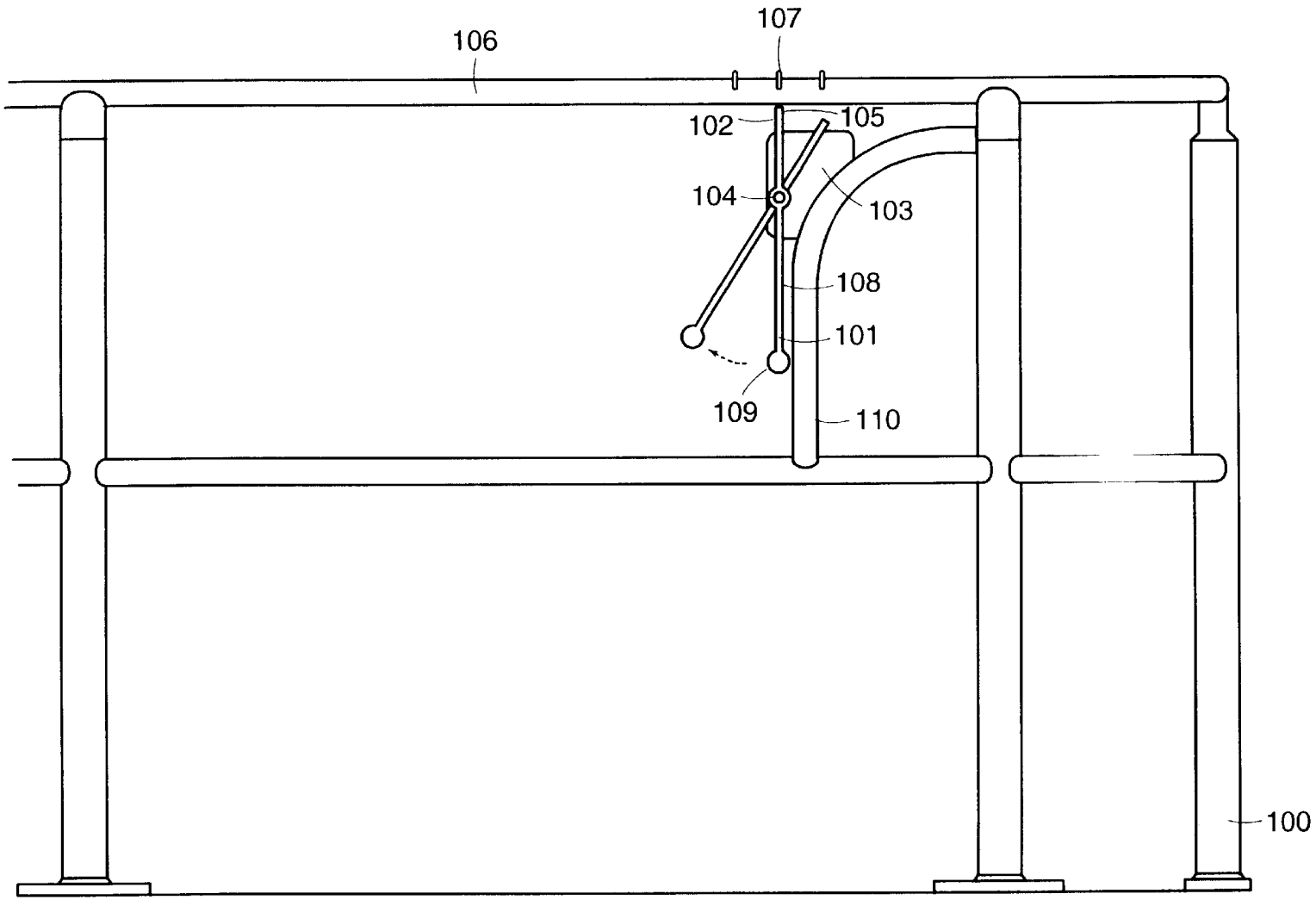

According to another embodiment of the present invention shown in FIG. 8 a railing 100 can be provided with a direction indicator 101 which effectively consists of a planar member 102 attached to a bracket 103 through a pivot 104. An upper section of the direction indicator 105 is arranged perpendicular to a horizontal handrail 106 and close enough to this handrail so that a hand sliding along the handrail would contact section 105 located directly below it.

Above the direction indicator 101 tactile portions being surface protrusions 107 on the surface of the handrail 106 indicate that a direction indicator is therebelow.

The lower end 108 of the direction indicator 101 is provided with a knob 109 which is adjacent to a handrail arcuate section 110. This section 110 prevents the section 108 of the direction indicator from moving anticlockwise and as shown allows a person striking section 105 of the direction indicator to move it in a clockwise direction and thus gauge from this movement that progress can continue along the handrail to the right hand side of the handrail, but not to the left hand side.

The direction indicator can be urged by any suitable means back to its original resting configuration where section 105 lies perpendicular to the handrail 106 above it.

According to one possibility the knob 109 could be weighted so as to return it to its lower most location with the direction indicator aligned in the vertical orientation. Alternatively a spring loaded mechanism could be provided at the pivot 104.

Figure 9B:
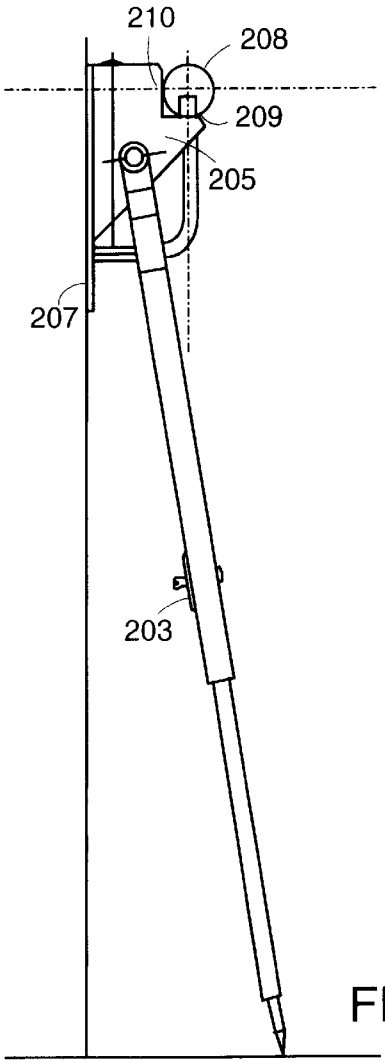
FIG. 9*b* shows a side view of the installation apparatus as shown in FIG. 9*a*.
Figure 9A:
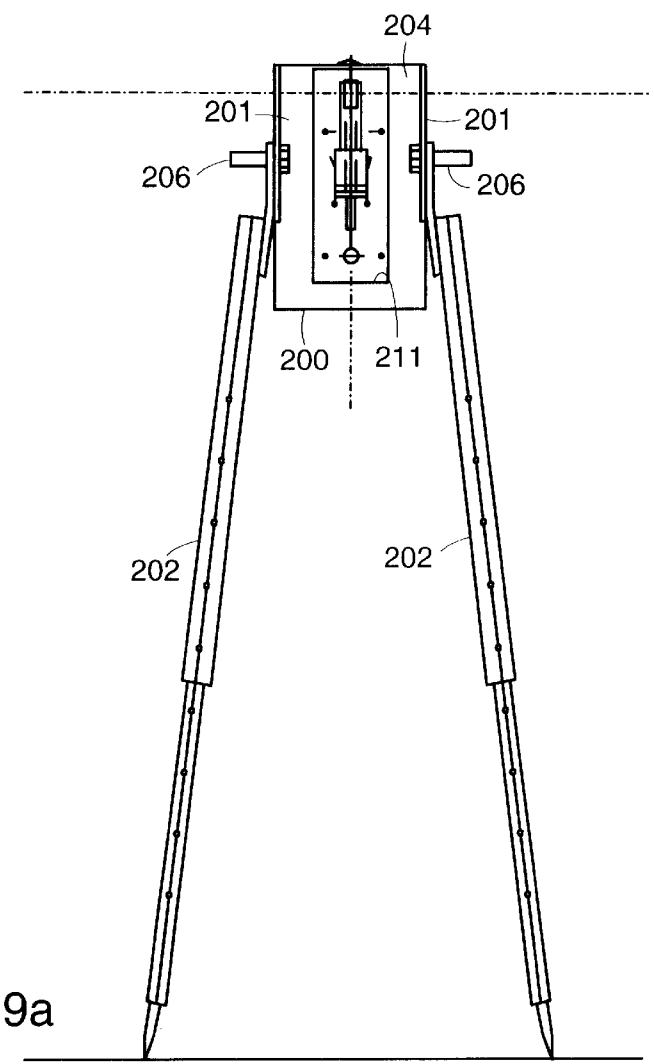
FIG. 9*a* shows a front view of an installation apparatus according to a first embodiment of the present invention.

To install a handrail assembly system incorporating the direction indicators previously described, according to one embodiment an assembly apparatus as shown in FIGS. 9*a* and 9*b* can be utilised.

As shown in FIG. 9*a* the assembly apparatus 200 consists of a locating bracket 201 having supporting legs 202. The supporting legs are telescopic with a fixing pin 203 to allow the height of the legs to be adjusted and fixed.

The locating bracket 201 consists of a back face 204 and two perpendicular side faces 205. A leg is attached to each of the side faces 205 by a pivotal locking pin 206.

The side faces 205 are shaped so that an upper portion fits between a side wall 207 and the intended location of a handrail 208. A lower lip portion 209 of each side bracket 205 is shaped to rest directly under handrail 208 when side bracket 205 is flush with side wall 207 so that the handrail 208 abuts perpendicular edge faces 210 and 209. From the right hand edge of lip 209 the side bracket 205 then extends down at an angle of approximately 45° until it contacts back section 204.

The back section 204 can be provided with a rectangular cut out section which is exactly the same shape as the support bracket which is to hold the direction indicator or which is already provided with the direction indicator. The support bracket 211 can then be inserted in the space provided in back section 204 and can be attached to the side wall 207. Thus a simple way is provided of accurately locating the direction indicator in the correct position.

According to another variation of the invention the handrail, balustrading and support bracket can be attached to the side wall first by using the installation apparatus 201. This is simply achieved by locating the handrail 208 so that it contacts side faces 209 and 210 of side bracket 205. Once the support bracket is attached to the side wall the direction indicator having a support bracket for example as shown in FIG. 7*b* can then be located in the correct position by either a corresponding cutout shape in the back face 204 or alternative locating indicators of the assembly apparatus.

An advantage of the present system is that it does not discriminate against visually impaired people.

What is claimed is:

1. A railing system for aiding emergency evacuation of people from a building comprising:

a plurality of handrails which are installed on walls of the building and which provide hand hold support to said people; and a plurality of direction indicators each of which is physically connected to a corresponding one of the plurality of handrails, each direction indicator of said plurality of direction indicators comprising a tactile portion which indicates the direction a person must move in to find an exit, each one of said plurality of handrails having connected thereto at least one of the plurality of direction indicators, wherein said plurality of direction indicators includes indicators of a first type which convey directional information for directing a person from the corresponding handrail across a discontinuity to a target location at which there is another handrail of said plurality of handrails or an exit, wherein the tactile portions of the indicators of the first type include shaped rail portions of a first shape and shaped rail portions of a second shape, wherein the first and second shapes convey different directional information, the first shape being characterized by a flat end surface that is perpendicular to the direction of the handrail to which it is attached and indicating to the person to continue along the direction of the corresponding handrail across a discontinuity to a target location and the second shape being characterized by a flat end surface that is oriented at an angle less than 90° relative the direction of the handrail to which it is attached and indicating to the person to turn 90° to the direction of the corresponding handrail and across a discontinuity to a target location, the direction of the turn depending on the orientation of the angled end surface.

2. A railing system as claimed in claim 1, wherein at least one of the handrails has more than one of said plurality of direction indicators connected thereto.

3. A railing system as claimed in claim 1 further comprising a support structure for each of said plurality of handrails, said support structures attaching said plurality of handrails to walls of the building.

4. A railing system as claimed in claim 1, further comprising a support structure for each of said plurality of handrails and wherein said plurality of direction indicators includes indicators of a second type, each of said indicators of the second type comprising a moveably mounted indicator member mounted on a corresponding support structure, said indicator member configured to be moveable from a first position to a second position to indicate that a person moving said indicator member should proceed in the direction in which said member is moveable.

5. A railing system as claimed in claim 4, wherein each direction indicator of the second type is arranged in a location where it is contacted by a person whose hand is in contact with the handrail of the railing system as that person is using the handrail system.

6. A railing system as claimed in claim 4, wherein each of said indicators of the second type further comprises an urging means for urging the moveably mounted indicator member to the first position.

7. A railing system as claimed in claim 4 wherein the indicator member in each of said indicators of the second type is pivotally mounted to pivot between the first and the second positions.

8. A railing system as claimed in claim 7, wherein said indicator member in each of said indicators of the second type is mounted in an orientation substantially perpendicular to the handrail with which it is in close proximity.

9. A railing system as claimed in claim 6 wherein said urging means in each of the indicators of the second type comprises a first and a second surface, the first surface being a cam surface arranged to co-operate with the second surface of the urging means to return the indicator member to the first position when moved away therefrom.

10. A railing system for aiding emergency evacuation of people from a building, said railing system comprising:

a plurality of handrails which are installed on walls of the building and which provide hand hold support to said people; and a plurality of direction indicators each of which is physically connected to a corresponding one of the plurality of handrails, each direction indicator of said plurality of direction indicators comprising a tactile portion which indicates the direction a person must move in to find an exit, each one of said plurality of handrails having mounted thereon at least one of the plurality of direction indicators, wherein said plurality of direction indicators includes indicators of a first type each of which comprises an elongate member with an indicator member extending laterally therefrom wherein said elongate member is pivotally mounted to pivot between a first, a second, and a third position such that said indicator member pivots from the first to the second position when movement in one direction is being signaled and from the first to the third position opposite to that of the second position when movement in two opposite directions is being signaled, wherein the indicators of the first type make up the tactile portions of the corresponding direction indicators.

11. A railing system as claimed in claim 10, further comprising:

a plurality of support members, each of which has an upper surface, and wherein in each indicator of the first type said elongate member comprises a shaft having a cam surface at its lower end which is arranged to engage the upper surface of a corresponding one of said plurality of support members.

12. A railing system as claimed in claim 11, wherein the cam surface in each indicator of the first type comprises a convex lowermost portion and an upper surface of each of said plurality of support members comprises a concave portion, wherein the concave portion of the upper surface of each support member is shaped and positioned so as to receive the convex lowermost portion of cam surface of a corresponding indicator of the first type.

13. A railing system as claimed in claim 12, wherein the cam surface of said elongate member in each indicator of the first type is shaped and oriented so as to be rotatable with respect to the upper surface of the support member which receives that cam surface.

14. A railing system as claimed in claim 13, wherein the cam surface of said elongate member in each indicator of the first type comprises a cam member which is substantially rectangular in shape and is positioned and oriented to be received over a lower portion of the elongate member.

15. A railing system for aiding emergency evacuation of people from a building, said railing system comprising:

a plurality of handrails installed in the building and which provide hand hold support to said people; and a plurality of direction indicators, each indicator comprising a tactile portion which indicates the direction a person must move in to find an exit, there being at least one of said plurality of direction indicators physically connected to each one of the plurality of handrails, wherein said plurality of direction indicators includes direction indicators of a first type, each of said indicators of the first type including a mechanism which is moveable from a first position substantially perpendicular to the handrail to a second position substantially parallel to the handrail to indicate that a person moving that mechanism should proceed in the direction in which that mechanism is moveable, wherein the indicators of the first type make up the tactile portions of the corresponding direction indicators.

16. A railing system as claimed in claim 15, wherein each of the direction indicators of the first type further comprises a mounting structure which connects the moveable mechanism for that direction indicator to the handrail to which that direction indicator is connected and which mounts the handrail to which that direction indicator is connected to a corresponding wall of the building.

17. A railing system as claimed in claim 16, wherein each indicator of the first type comprises a stop for limiting movement of the mechanism in said direction indicator, said stop mounted onto the mounting structure for the direction indicator of which that stop is a part.

18. A railing system as claimed in claim 1, wherein the direction indicators of the first type are located at ends of at least some of said plurality of handrails.

19. A direction indicator for a railing system for emergency evacuation of people from a building comprising an indicator member and a supporting mechanism which permits the indicator member to be moveable from a first position to a second position to indicate that a person moving the indicator member should proceed in the direction in which the member is moveable.

20. A direction indicator as claimed in claim 19, comprising an urging means for urging the indicator member to the first position.

21. A direction indicator as claimed in claim 20, comprising a pivot means to allow the indicator member to pivot within the supporting mechanism between first and second positions.

22. A railing system as claimed in claim 3, wherein the plurality of direction indicators includes a plurality of indicators of a second type, each of said indicators of the second type comprising an indicator member and a supporting mechanism which renders the indicator member moveable from a first position to a second position to indicate that a person moving the indicator member should proceed in the direction in which the member is moveable.

23. A railing system as claimed in claim 22, wherein each indicator of the second type also comprises an urging means for urging the indicator member to the first position.

24. A railing system as claimed in claim 22 wherein in each indicator of the second type the indicator member is pivotal between the first and second positions.

25. A railing system as claimed in claim 6 wherein in each indicator of the second type the indicator member is pivotal between the first and second positions.

26. A railing system as claimed in claim 23 wherein in each indicator of the second type the indicator member is pivotal between the first and second positions.

27. A railing system as claimed in claim 23, wherein in each indicator of the second type the indicator member is substantially perpendicular to the handrail to which the indicator of the second type is closely proximate.

28. A railing system as claimed in claim 24, wherein in each indicator of the second type the indicator member is substantially perpendicular to the handrail to which the indicator of the second type is closely proximate.

29. A railing system as claimed in claim 26, wherein in each indicator of the second type the indicator member is substantially perpendicular to the handrail to which the indicator of the second type is closely proximate.

30. A railing system as claimed in claim 23 wherein in each indicator of the second type the urging means comprises a cam surface which is arranged to cooperate with another surface of the urging means to return the indicator member to the first position when moved away therefrom.

* * * * *